US005271633A

United States Patent [19]

Hill, Jr.

[11] Patent Number: 5,271,633

[45] Date of Patent: Dec. 21, 1993

[54] IN-LINE ROLLER SKATE HAVING EASILY REPLACEABLE BEARINGS

[76] Inventor: William C. Hill, Jr., 4018 42nd Ave., N., St. Petersburg, Fla. 33714

[21] Appl. No.: 50,507

[22] Filed: Apr. 20, 1993

[51] Int. Cl.[5] ..... A63C 17/06; A63C 17/22

[52] U.S. Cl. ..... 280/11.22; 280/809; 29/724; 29/898.08; 301/5.7; 301/111; 301/114; 384/510

[58] Field of Search ..... 280/11.22, 11.23, 11.27, 280/11.19, 7.13, 7.14, 809, 87.042; 29/724, 898.08; 301/5.3, 5.7, 111, 114, 115, 125; 384/510, 544, 903

[56] References Cited

U.S. PATENT DOCUMENTS

| | | | |
|---|---|---|---|
| 954,993 | 4/1910 | Peters | 280/11.22 X |
| 2,105,354 | 1/1938 | Hoerle | 301/5.7 X |
| 2,245,769 | 6/1941 | Flamm | 280/11.19 |
| 2,701,740 | 2/1955 | Norman | 301/5.7 |
| 3,360,314 | 12/1967 | DiLoreto | 301/5.7 X |
| 3,837,662 | 9/1974 | Marks et al. | 284/544 X |
| 4,034,995 | 7/1977 | Forward et al. | 280/11.23 X |
| 4,666,168 | 5/1987 | Hamill et al. | 280/11.23 X |
| 4,666,169 | 5/1987 | Hamill et al. | 280/11.27 X |
| 4,694,569 | 9/1987 | Colvell et al. | 29/724 |
| 4,711,458 | 12/1987 | Shim | 280/11.22 |

FOREIGN PATENT DOCUMENTS

| | | | |
|---|---|---|---|
| 0295081 | 12/1988 | European Pat. Off. | 280/11.22 |

*Primary Examiner*—Brian L. Johnson

*Attorney, Agent, or Firm*—Herbert W. Larson

[57] ABSTRACT

A skate housing assembly for high speed in-line roller skates. There is a frame with a top surface attached to a sole of a skate boot and two descending side skirts having multiple linear transverse bores. A pocket located on the inside surface of each descending skirt surrounding a bore receives a flange from a bearing insert mounted within a skate wheel. A shaft axially mounted through the skirt bores and bearing insert aligns the wheel on the skate housing.

9 Claims, 5 Drawing Sheets

IN-LINE ROLLER SKATE HAVING EASILY REPLACEABLE BEARINGS

BACKGROUND OF THE INVENTION

1. Field of the Invention

This invention relates to in-line roller skates. More particularly, it relates to in-line roller skates with removable wheels having quick release bearings for rapid replacement of the bearings 2. Description of Prior Art In-line roller skates are known and currently used by individuals for purposes of exercise, pleasure, and racing as seen in U.S. Pat. Nos. 3,837,662, 4,034,995, 4,666,168, and 4,666,169.

Individuals who use in-line roller skates for exercise and pleasure must keep their skates in good working order and must periodically replace worn out parts, such as wheels and bearings, so that the skate may continue to function properly. Individuals who race and compete using in-line roller skates must keep their skates in top working condition and are frequently forced to replace parts, such as wheels and bearings, during competition caused by the additional stress placed on them during such competition.

The known in-line roller skates do not have easily replaceable bearings to permit quick re-entry of a racer into competition. Further, the known in-line roller skates are not equipped with alignment elements which would enable the skater to quickly drop in and align a wheel for rapid replacement These two inadequacies cause the skater to use too much time for repairs thereby resulting in either a loss or disqualification from a race.

There exists a need for an in-line roller skate with a removable wheel with quick release bearings for in-line roller skate racing enthusiasts.

SUMMARY OF THE INVENTION

I have invented an improved in-line roller skate which enables a skater to quickly replace wheels and bearings with minimal effort.

My invention employs a skate housing assembly supporting a single row of skate wheels spaced to accommodate 3 to 5 wheels of varying diameters The housing is attached to a skate boot. A bolt axially aligns transverse bores in the housing and a pair of bearing inserts enclosed in a wheel hub. The bolt extends through reciprocal transverse housing bores on opposite sides of the housing. A flange protruding at a first end from the bearing insert sits in a pocket in an inside surface of the skate housing to align the wheel.

The skate wheel and bearing inserts are both fashioned for rapid replacement and alignment. A skater may easily replace a wheel or bearing insert by unscrewing the bolt and allowing the wheel to drop from the skate housing. A bearing tool having a shaft with a pair of nipples at a distal end from the handle are inserted into a grooved axial bore of each bearing insert. The pair of nipples on the shaft of the bearing tool lock with the groove on an inner surface of the bearing insert. The bearing insert is removed from the wheel hub by pulling on the bearing tool at an opposite direction with respect to the wheel. A replacement bearing can be easily inserted by pushing it into the wheel hub with a thumb surface. Once the pair of bearing inserts have been replaced, the wheel with the protruding bearing insert flange is dropped into the opposed housing pockets, thereby aligning the wheel. The bolt is then reinserted through the transverse bores and bearing inserts. The skate is now ready for use once again.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
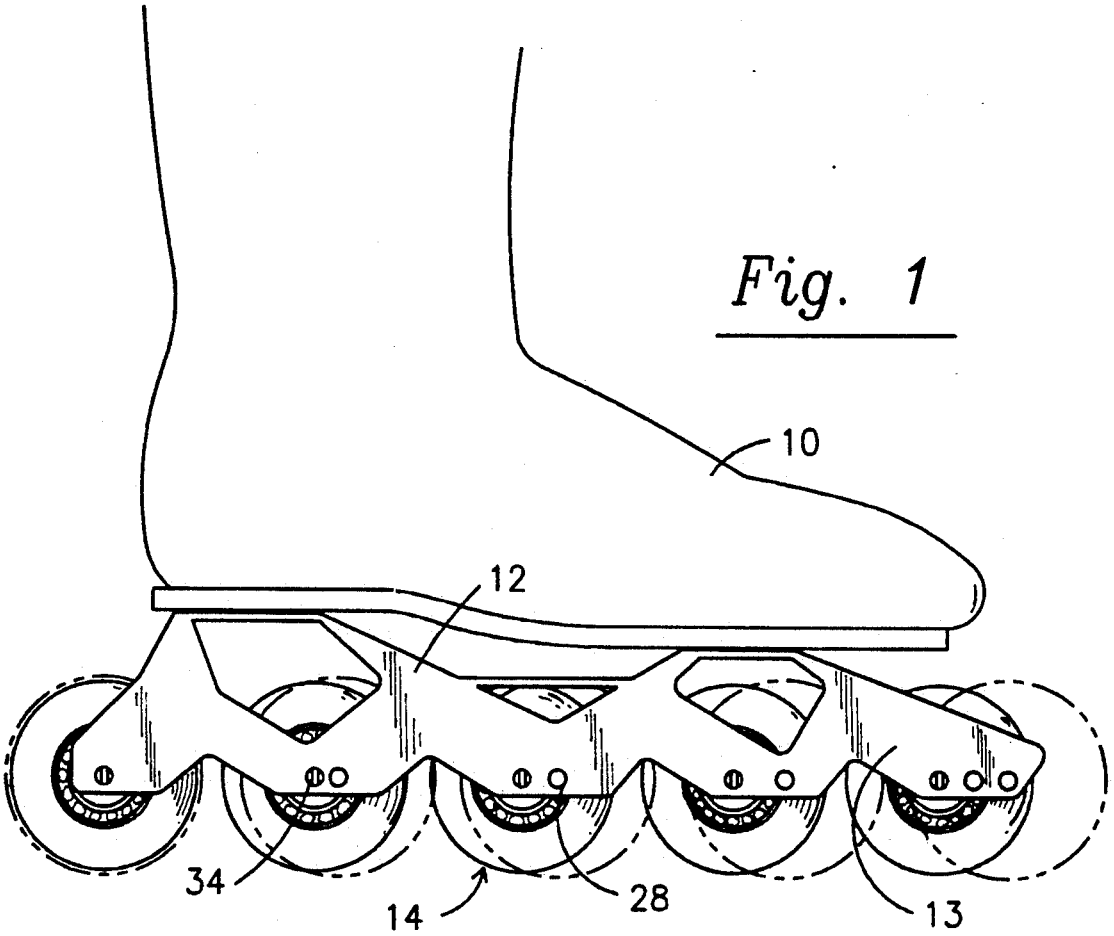
FIG. 1 is a side elevational view of the skate housing with mounted wheels attached to a boot.

Throughout the following detailed description, the same reference numerals refer to the same elements in all figures.

Figure 2:
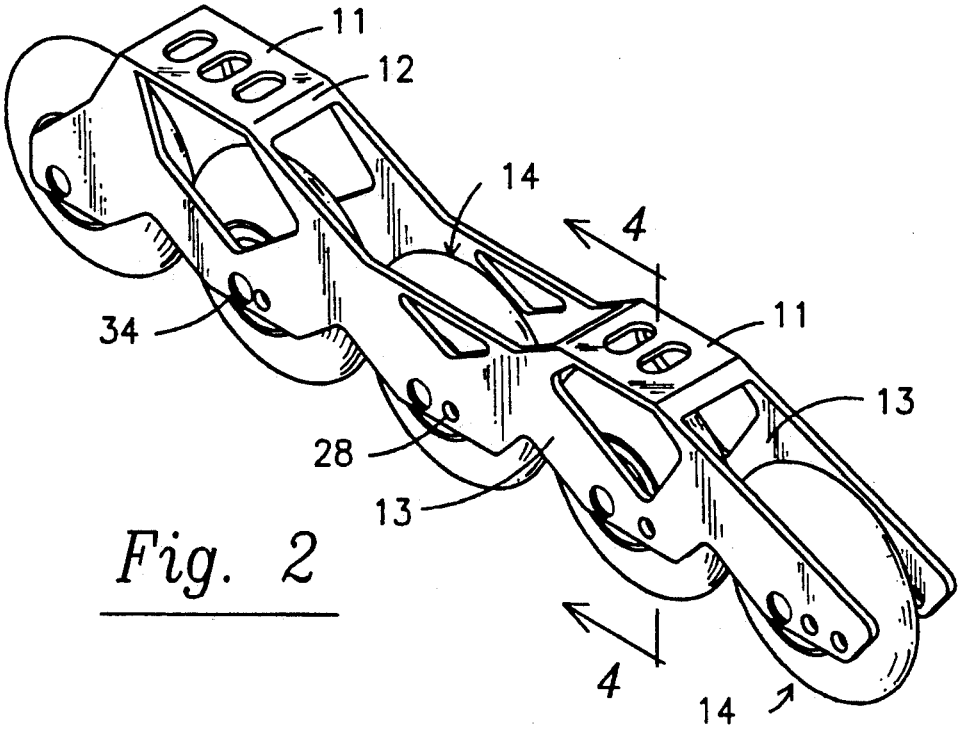
FIG. 2 is a perspective view of the skate housing with five mounted wheels.

A skate boot 10 is attached by conventional means to the horizontal top plane 11 of a skate housing assembly 12 as shown in FIG. 1. A single row of skate wheels 14 are aligned along an undercarriage of the skate housing 12 as shown in FIG. 2. The row of skate wheels 14 are bolted to identical skirts 13 descending from opposite longitudinal side edges of the top plane 11 as shown in FIG. 2.

Figure 3:
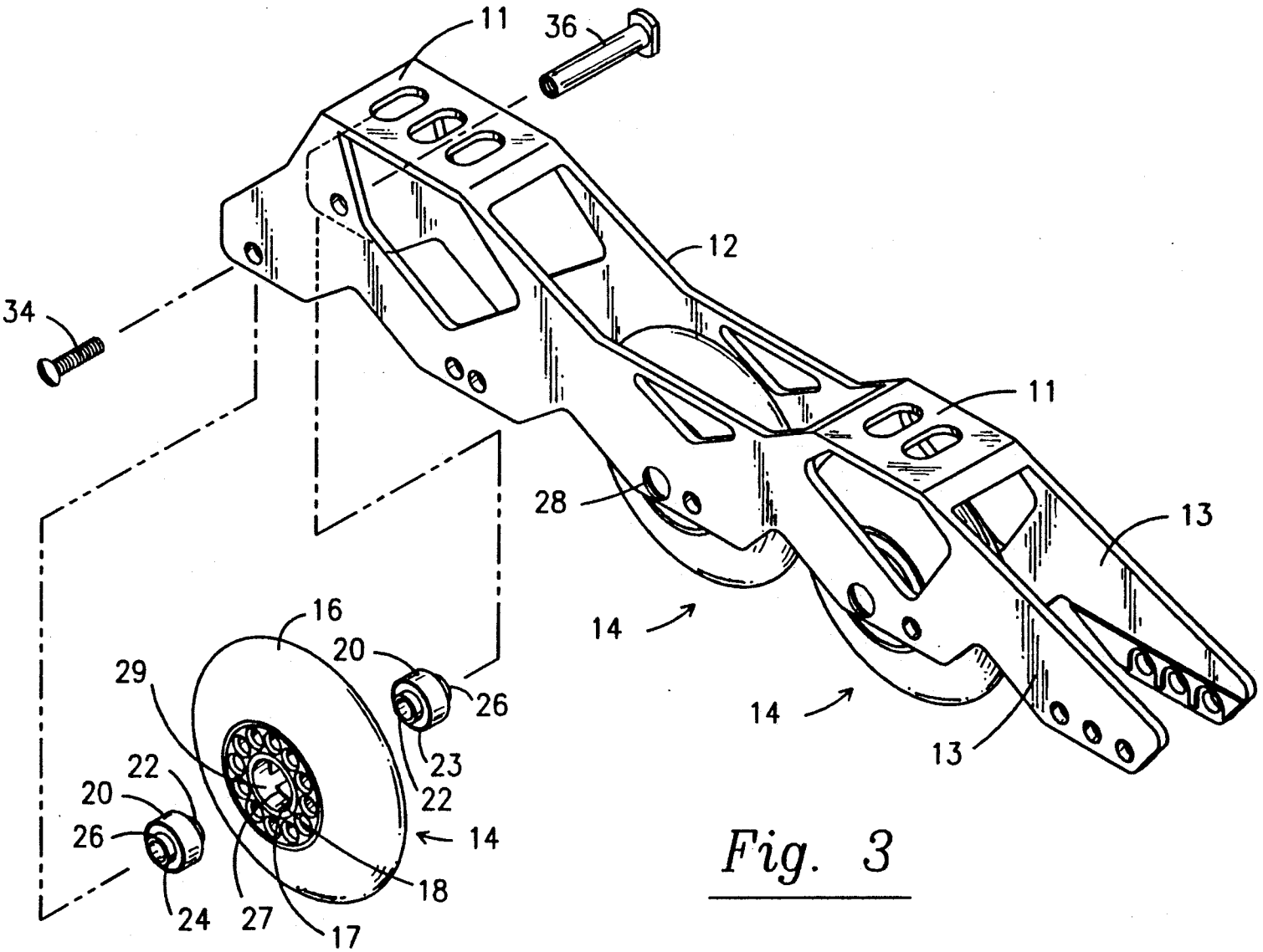
FIG. 3 is an exploded view of the skate housing showing a skate wheel and pair of bearings removed from the skate housing.
Figure 5:
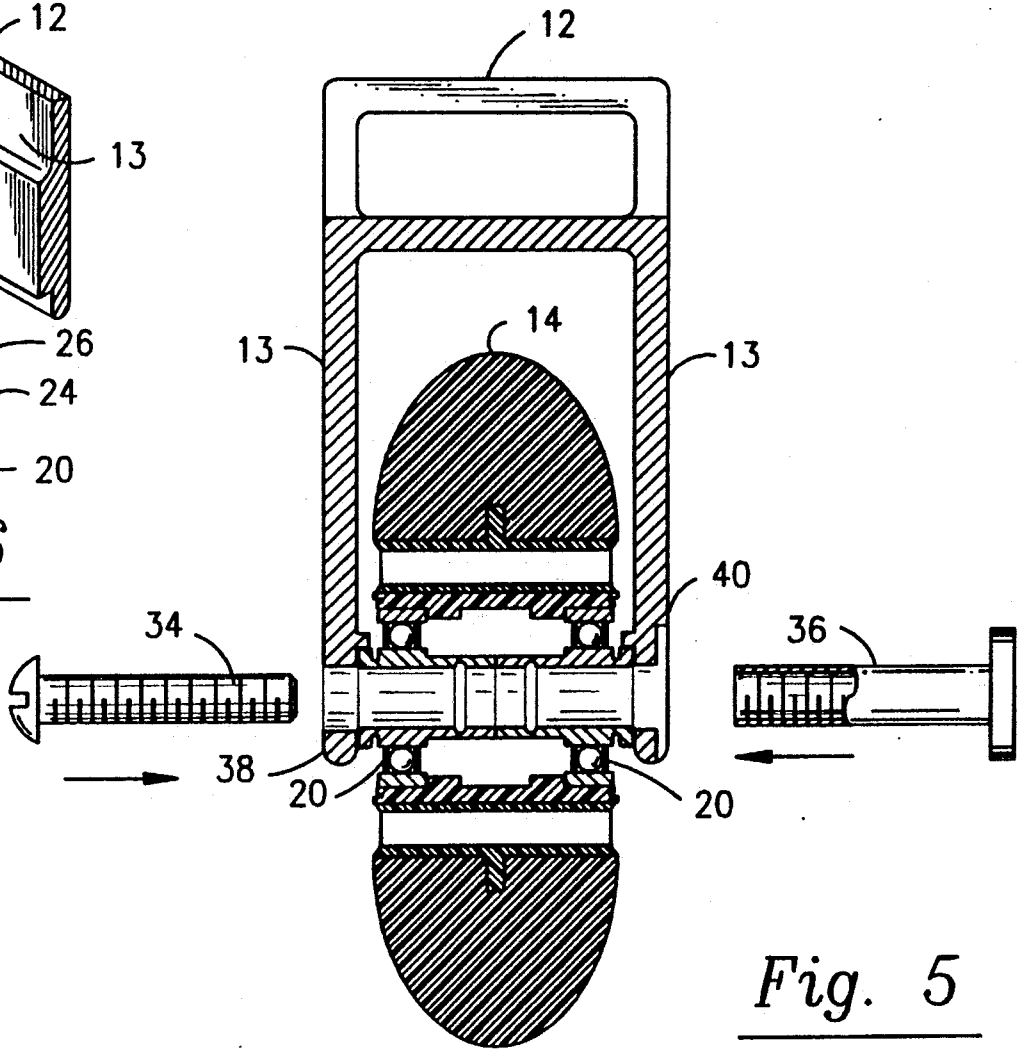
FIG. 5 is a sectional view of the skate housing with a mounted wheel in a pocket along lines 4—4 of FIG. 2 with a bolt removed.
Figure 6:
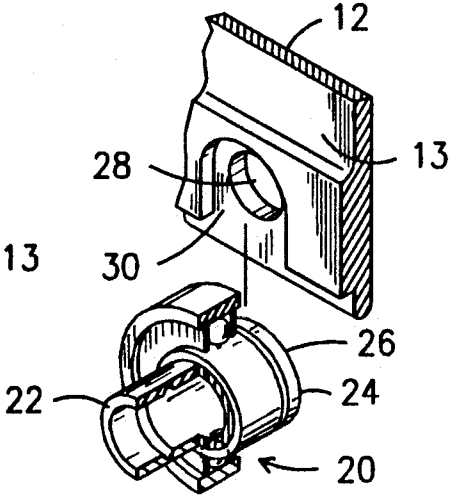
FIG. 6 is a sectional perspective view of a bearing insert about to be inserted into a pocket of the skate housing.
Figure 4:
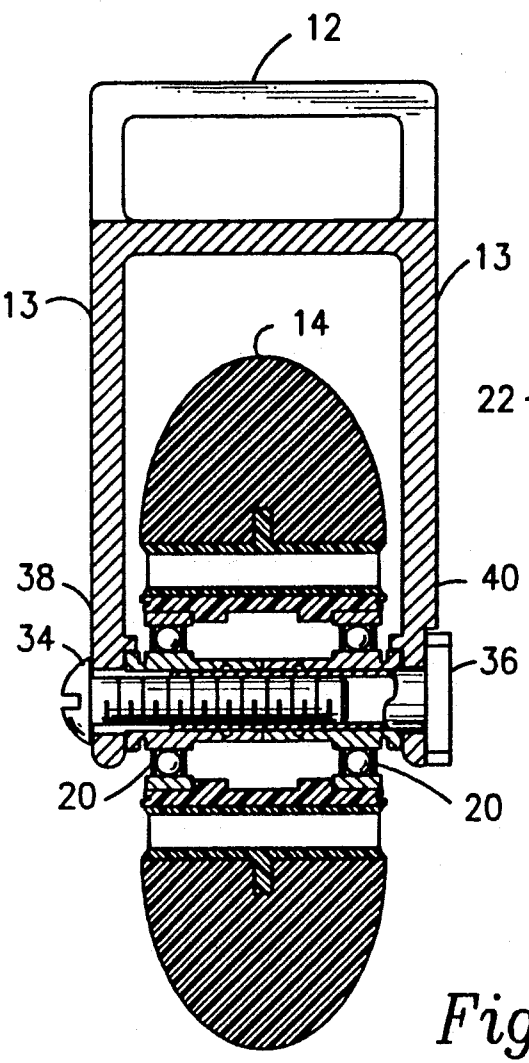
FIG. 4 is a sectional view of the skate housing with a mounted wheel in a pocket along lines 4—4 of FIG. 2 with a bolt inserted.

The skate wheel 14 consists of a circular polymer member 16, a mounting hub 17, and a central axial bore 18 manufactured to receive a pair of bearing inserts 20 as shown in FIG. 3. Each bearing insert 20 is pressed into opposite sides of the central axial bore 18 and abut at a second end 22 of the bearing insert 20 in about the middle of the central axial bore 18 as shown in FIGS. 4 and 5. A flange 24 protrudes from a first end 26 of each bearing insert 20 as shown in FIGS. 3 and 6. A ridge 27 on an inner surface 29 of the mounting hub 17 provides a stop for the inner edge 23 of a bearing insert 20 as shown in FIG. 3.

Each descending skirt 13 of the skate housing 12 contains a plurality of transverse bores 28 located along the longitudinal side plane of the skate housing 12 as shown in FIG. 3. Each transverse bore 28 has a corresponding wheel alignment pocket 30 located on the inside surface of the descending skirt 13 of the skate housing 12 along the longitudinal plane as shown in FIG. 6.

The flange 24 of the bearing insert 20 engages with the pocket 30, as shown in FIG. 6, to align the wheel 14. A bolt 34 axially aligns the transverse bore 28 at a first side 38 on the frame skirt 13 with the bearing insert 20 as shown in FIGS. 4 and 5. The bolt 34 is received by a female hex nut 36 inserted transversely from a second side 40 on the frame skirt 13 as shown in FIGS. 4 and 5.

Figure 9:
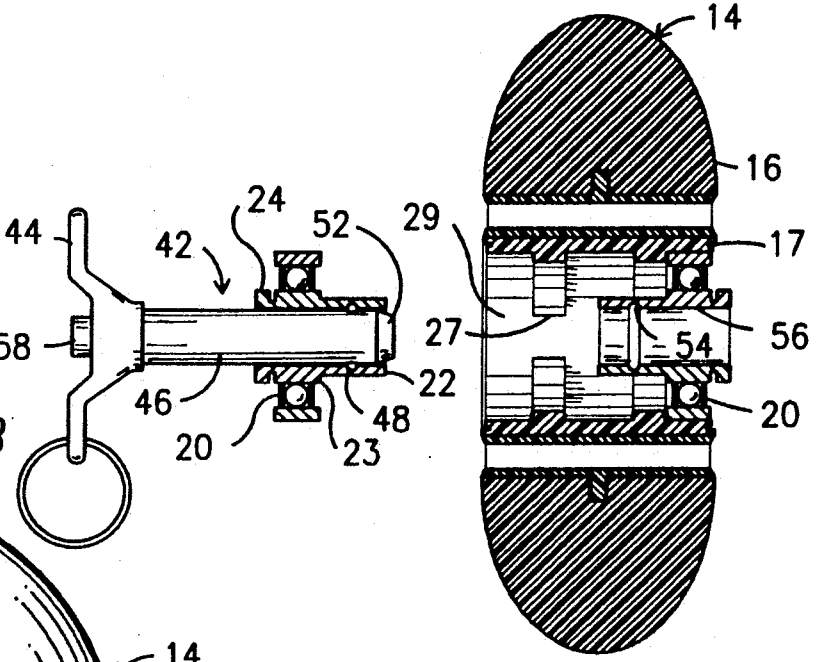
FIG. 9 is a sectional view of the skate wheel along lines 8—8 of FIG. 7 with a bearing tool removing a bearing insert from the skate wheel.
Figure 7:
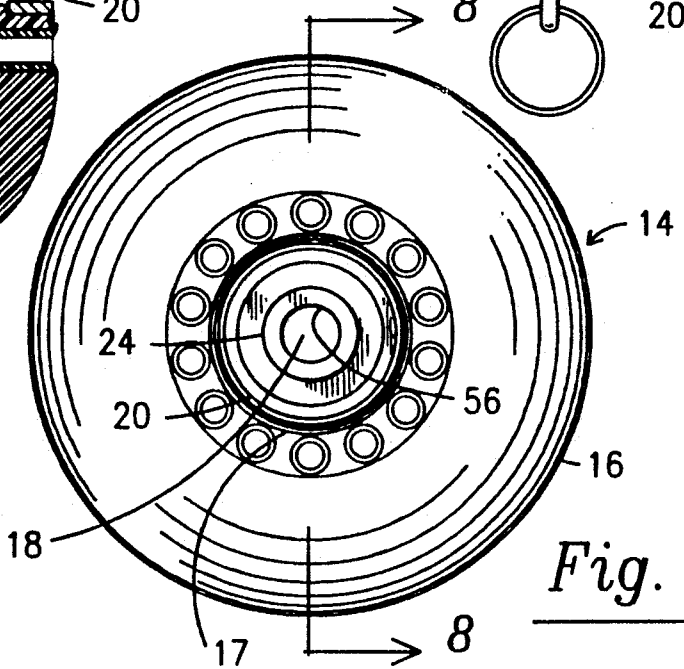
FIG. 7 is a side elevational view of a wheel with bearings in place.
Figure 8:
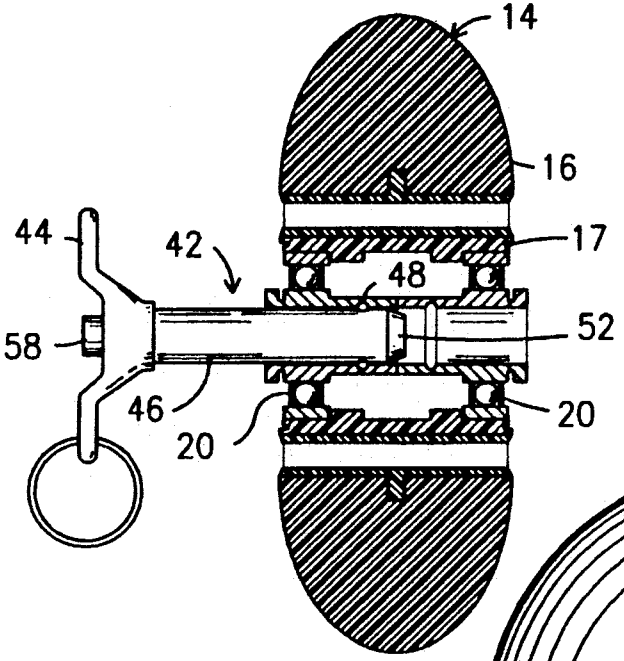
FIG. 8 is a sectional view of a skate wheel along lines 8—8 of FIG. 7 with a bearing tool inserted into a bearing insert.
Figure 10:
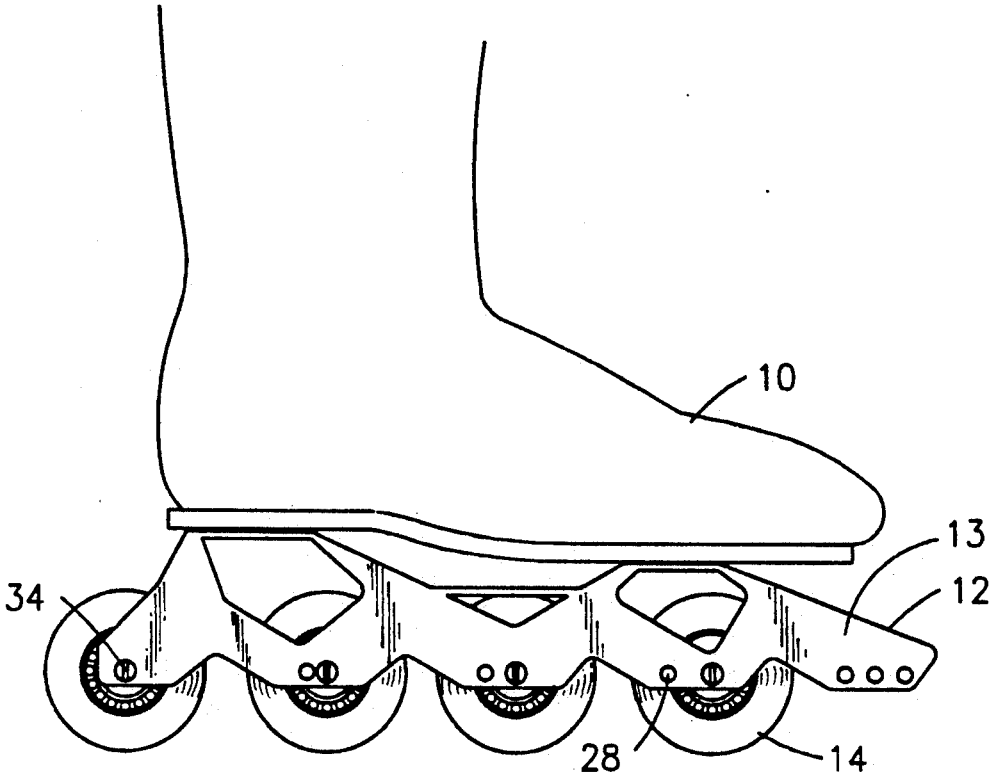
FIG. 10 is a side elevational view of the skate housing showing an alternate skate wheel configuration.
Figure 11:
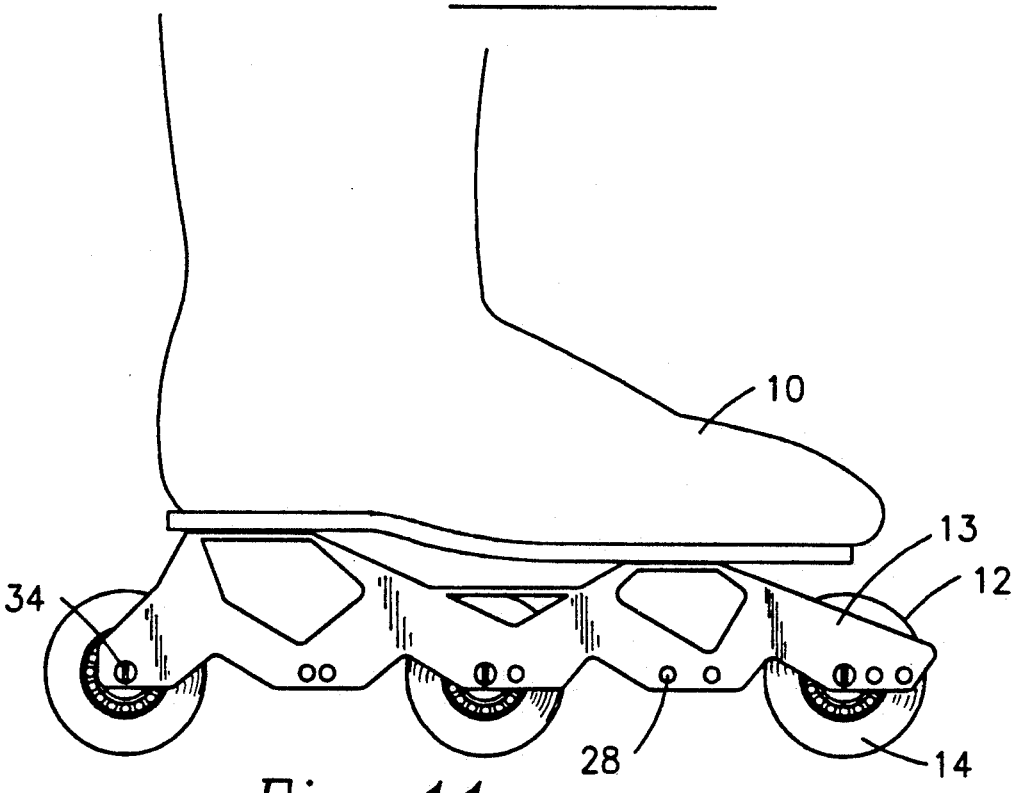
FIG. 11 is a side elevational view of the skate housing showing a second alternate skate wheel configuration.

The bearing insert 20 may be removed from the central axial bore 18 of the skate wheel 14 with a bearing tool 42 as shown in FIGS. 8 and 9. The bearing tool 42 has a head portion 44, a shaft 46, a pair of nipples 48 located at a distal end portion 52 with respect to the head portion 44, and a nipple release button 58 located in the head portion 44 of the bearing tool 42, as shown in FIGS. 8 and 9. The shaft 46 of the bearing tool 42 is axially inserted into the bearing insert 20 as shown in FIGS. 8 and 9. The nipples 48 drop into respective grooves 54 located on an inner surface 56 of the bearing insert 20 as shown in FIG. 9. The bearing tool 42, with the engaged bearing insert 20, is pulled in an opposite direction with respect to the skate wheel 14, thereby removing the bearing insert 20 from the axial bore 18 of the skate wheel 14 as shown in FIG. 9. The nipple release button 58 depresses an internal spring to release pressure on the nipples 48 and disengages the bearing tool 42 from the bearing insert 20. The bearing insert removal process is repeated for the reciprocal bearing insert 20 located in each central axial bore 18 within the hub 17 of each skate wheel 14.

New bearing inserts 20 are inserted into the central axial bore 18 within the hub 17 of the skate wheel 14 by use of a thumb surface. The wheel 14 is inserted into the skate housing 12 by engaging the flange 24 with the pocket 30.

Different skate wheels 14 of varying diameters and number may be substituted in the skate housing 12. The skate housing 12 may accommodate 3 to 5 skate wheels 14 with diameters ranging from 76 mm to 82 mm.

The skate frame housing 12 is generally made from a strong lightweight metal such as aluminum or titanium, but also could be constructed with a high strength polymer. The bolt 34 is generally made from stainless steel. The circular member 16 and the hub 17 of the skate wheel 14 are generally made from a hard polymer.

Equivalent mechanical devices can be substituted for the ones set forth above to achieve the same results in the same manner.

Having thus described the invention what is claimed and desired to be secured by Letters Patent is:

1. A skate housing assembly for a high speed in-line roller skate comprising a longitudinal frame having an intermittent top surface adapted to be attached to a sole of a shoe, identical frame skirts descending from opposite side edges of the top surface, multiple linear transverse bores located in a bottom portion of the descending frame skirts, an inside surface of the descending frame skirts surrounding each transverse bore configured to form a pocket, three to five wheels mounted in a row, each wheel supported on a hub containing a central axial bore, the central axial bore aligned within the longitudinal frame with the transverse bore of opposed frame skirts on opposite sides of each wheel, a pair of bearing inserts mounted within the central axial bore through the wheel hub, the bearing inserts having a flange at a first end for seating in the pocket and a shaft element through the bores to retain the wheels within the frame.

2. A skate housing assembly for a high speed in-line roller skate according to claim 1 wherein the shaft element is a bolt retaining the wheel in place on the skate housing frame.

3. A skate housing assembly for a high speed in-line roller skate according to claim 1 wherein each bearing insert has an axial bore for receiving the shaft element and a groove within an inside surface for receiving a bearing removal tool.

4. A skate housing assembly for a high speed in-line roller skate according to claim 1 wherein each wheel hub central axial bore receives a pair of bearing inserts abutting at a second end about half way through the wheel hub central axial bore and an inner edge of the bearing insert is stopped by a ridge located on an inner surface of the wheel hub.

5. A skate housing assembly for a high speed in-line roller skate according to claim 2 wherein the bolt is transversely mounted through the transverse bore of the descending frame skirt on a first side of the skate housing assembly, through the bearing inserts enclosed in the wheel central axial bore, and through an opposed transverse bore of the descending frame skirt on a second side of the skate housing assembly.

6. A skate housing assembly for a high speed in-line roller skate according to claim 5 wherein the bolt is received by a hex nut on the second side of the descending frame skirt of the skate housing assembly.

7. A skate housing assembly for a high speed in-line roller skate according to claim 3 wherein the bearing removal tool has a shaft with nipples located at a distal end from a head portion for engagement with the grooves on the inside surface of the bearing insert.

8. A skate housing assembly for a high speed in-line roller skate according to claim 1 wherein the wheel diameters may be 76 mm to 82 mm.

9. A skate housing assembly for a high speed in-line roller skate having 3–5 wheels, the housing assembly comprising a top surface having multiple bores for receiving attachment devices for securing the skate housing to the sole of a shoe, a pair of downwardly descending skirts from respective side edges of the top surface, multiple transverse bores along a lower portion of each skirt, a pocket formed around each bore on an inner surface of each skirt, each wheel having a hub for receipt of a pair of bearing inserts from opposite sides of the wheel, a first end of each bearing insert having a flange for engagement within the skirt pocket, each bearing insert having an internal groove along a central bore for receipt of a bearing removal tool, a shaft element mounted through the transverse bore of the skirt, through the central bore of the pair of bearing inserts and through the transverse bore on the opposite skirt and means for retaining the shaft element in place to axially align the wheel with respect to opposed skirt transverse bores.

* * * * *